US006593888B2

(12) United States Patent
Fu

(10) Patent No.: US 6,593,888 B2
(45) Date of Patent: Jul. 15, 2003

(54) INVERTED-F ANTENNA

(75) Inventor: Mao Li Fu, Hsinchu (TW)

(73) Assignee: Z-Com, Inc., Hsinchu (TW)

( * ) Notice: Subject to any disclaimer, the term of this patent is extended or adjusted under 35 U.S.C. 154(b) by 0 days.

(21) Appl. No.: 10/006,213

(22) Filed: Dec. 10, 2001

(65) Prior Publication Data

US 2002/0171587 A1 Nov. 21, 2002

(30) Foreign Application Priority Data

May 15, 2001 (TW) ..... 90111524 A

(51) Int. Cl.[7] ..... H01Q 1/38
(52) U.S. Cl. ..... 343/700 MS; 343/702
(58) Field of Search ..... 434/700 MS, 846, 434/848, 702

(56) References Cited

U.S. PATENT DOCUMENTS 4,791,423 A * 12/1988 Yokoyama et al. .. 343/700 MS
5,781,158 A * 7/1998 Ko et al. ..... 343/700 MS
6,008,762 A * 12/1999 Nghiem ..... 343/700 MS
6,114,996 A * 9/2000 Nghiem ..... 343/700 MS
6,297,776 B1 * 10/2001 Pankinaho ..... 343/700 MS
6,380,903 B1 * 4/2002 Hayes et al. ..... 343/725
6,456,243 B1 * 9/2002 Poilasne et al. ..... 343/700 MS

* cited by examiner

*Primary Examiner*—Tan Ho
(74) *Attorney, Agent, or Firm*—Bacon & Thomas, PLLC

(57) ABSTRACT

An inverted F-antenna includes a first plane; a second plane connecting to the first plane and having a gap; a third plane connecting to the second plane on an opposite side of the first plane; a fourth plane connecting to the third plane and having a distance from the first plane on an opposite side of the second plane; and a pillar connecting to a margin of the fourth plane and projecting to the gap of the second plane for forming the inverted-F antenna.

10 Claims, 3 Drawing Sheets

INVERTED-F ANTENNA

FIELD OF THE INVENTION

The present invention is related to an inverted-F antenna, and more particularly to an inverted-F antenna utilized in the wireless signal communication domain.

BACKGROUND OF THE INVENTION

The applications of wireless communication are very general in daily life, for example the wireless mobile phones, the wireless modems and the wireless network cards. The wireless devices utilize the RF (Radio Frequency) technique to meet the target of the communication between two clients in real-time. However, the antenna is an important component in the mechanical design of wireless signal transmission.

An antenna is always designed as a metal line or a planar surface having suitable shape for the wavelength of wireless signal. How to improve the inverted-F antenna for avoiding the weak point is the main topic of the present invention.

FIG. 1 shows shape structure of the conventional inverted-F antenna. This kind of inverted-F antenna has the obvious advantage in frequency bandwidth compared to the general antenna, bnt it is difficult to manufacture due to the structure. The inverted-F antenna consists of four planes 11,12,13,14 and a pillar 15 observing from the shape. The first plane 11 vertically connects to the second plane 12; the second plane 12 vertically connects to the third plane 13; and the third plane 13 vertically connects to the fourth plane 14. There is a distance d1 between the fourth plane 14 and the first plane 11. The pillar 1 5 connects to the fourth plane 14 and projects into the second plane 12. That is, one side of the pillar 15 is conductive electrically to the fourth plane 14 and the other side is isolated from the second plane 12. The manufacture of the pillar 15 is complicated. One side of the pillar 15 must First be soldered on the fourth plane 14 and then another side must coat an isolated material from the second plane 12, so the manufacture cost is quite expensive.

SUMMARY OF THE INVENTION

An object of the present invention is to provide an inverted-F antenna having a new shape for simplifying the manufacture steps.

Another object of the present invention is to provide an inverted-F antenna for reducing the cost, but the original properties of inverted-F antenna are reserved.

According to the present invention, an inverted-F antenna comprises a first plane; a second plane connecting to the first plane and having a gap; a third plane connecting to the second plane on an opposite side of the first plane; a fourth plane connecting to the third plane and having a distance from the first plane on an opposite side of the second plane; and a pillar connecting to a margin of the fourth plane and projecting to the gap of the second plane for forming the inverted-F antenna.

In accordance with one aspect of the present invention, the inverted-F antenna is made of a metal.

In accordance with one aspect of the present invention, the metal is a phosphor bronze.

In accordance with one aspect of the present invention, the gap is of "ㄇ" shape.

In accordance with one aspect of the present invention, the first plane is parallel to the third plane; the second plane is parallel to the fourth plane; the first plane is vertical to the second plane; and the third plane is vertical to the fourth plane.

In accordance with one aspect of the present invention, the pillar is vertical to the fourth plane and the second plane.

In accordance with one aspect of the present invention, the inverted-F antenna is connected to a printed circuit board.

In accordance with one aspect of the present invention, the printed circuit board has two of the inverted-F antennas.

In accordance with one aspect of the present invention, the inverted-F antenna is formed in a body.

According to the present invention, a method for forming an inverted-F antenna comprising steps of providing a prototype of the inverted-F antenna; and forming the inverted-F antenna from the prototype in a method of forming in a body.

In accordance with one aspect of the present invention, the inverted-F antenna comprises a first plane; a second plane connecting to the first plane and having a gap; a third plane connecting to the second plane on an opposite side of the first plane; a fourth plane connecting to the third plane and having a distance from the first plane on an opposite side of the second plane; and a pillar connecting to a margin of the fourth plane and projecting to the gap of the second plane for forming the inverted-F antenna.

The present invention may best be understood through the following description with reference to the accompanying drawings, in which:

DETAILED DESCRIPTION OF THE PREFERRED EMBODIMENT

Figure 1:
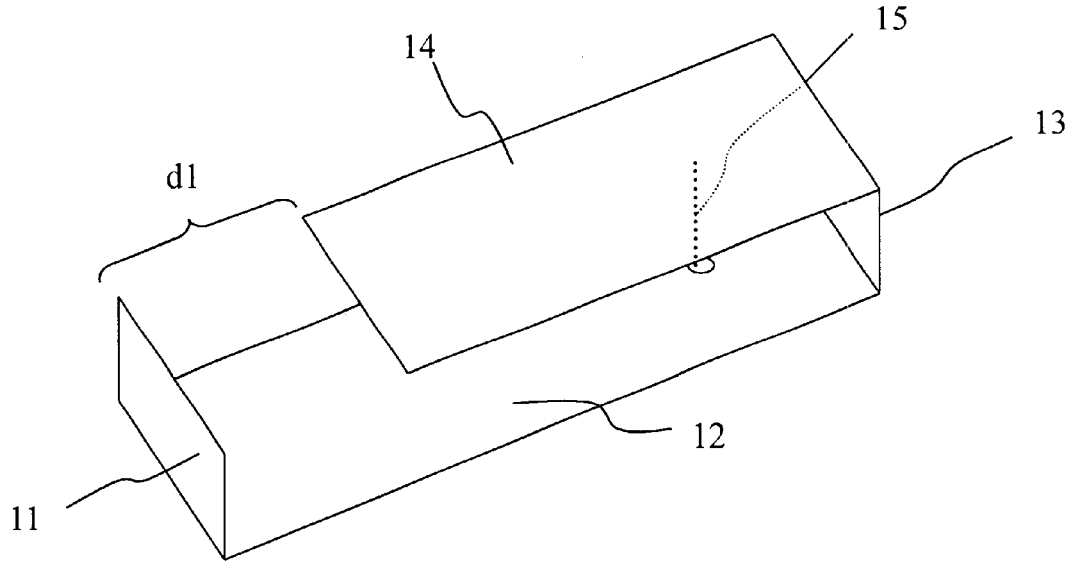
Figure 1 (prior art)
FIG. 1 is a conventional inverted-F antenna structure.
Figure 2:
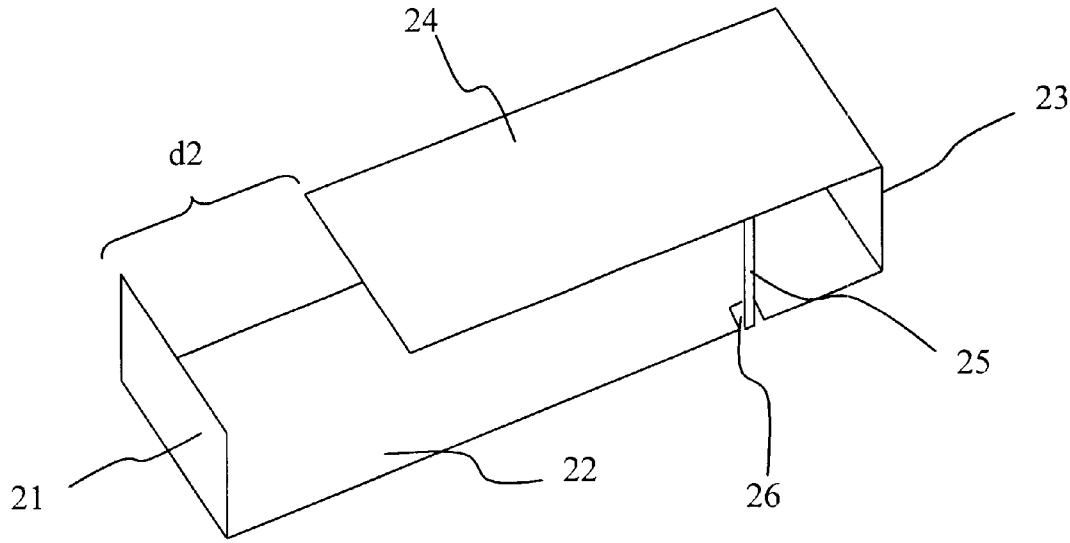
FIG. 2 is an inverted-F antenna structure according to the present invention.

Please refer to FIG. 2 showing the antenna structure which includes the the first plane 21, the second plane 22, the third plane 23, the fourth plane 24 and the pillar 25. The second plane 22 has a gap 26 for isolating the pillar 25 from the second plane 22. There is a distance d2 between the first plane 21 and the fourth plane 24. One side of the pillar 25 is connected to the margin of the fourth plane 24 and another side of the pillar 25 projects to the gap 26 of the second plane for forming the inverted-F antenna. The gap 26 is in the shape of "ㄇ". The inverted-F antenna is made of a metal material such as phosphor bronze. The first plane 21 is parallel to the third plane 23; the second plane 22 is parallel to the fourth plane 24; the first plane 21 is vertical to the second plane 22; and the third plane 23 is vertical to the fourth plane 24.

The manufacture steps are simplified because the pillar 25 is connected to the margin of the fourth plane 24. The inverted-F antenna can he easily formed by a machine process. There is no need for the present invention to use a handwork on soldering the pillar. Due to the steps being simplified, the production cost may be down and the potential of the product will be promoted further.

Figure 3:
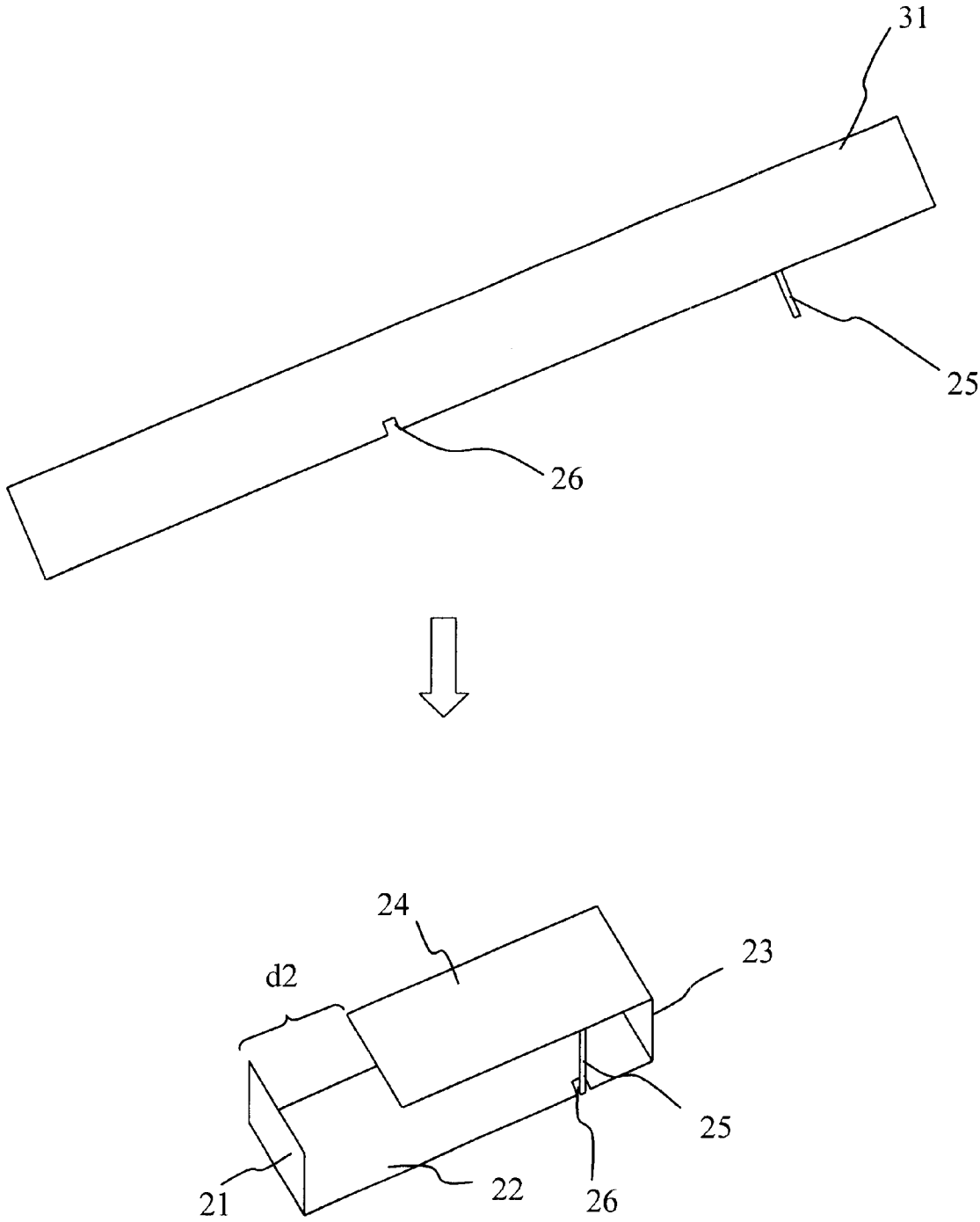
FIG. 3 is an manufacture method of the inverted-F antenna according to the present invention.

Please refer to FIG. 3 showing the manufacture steps of the inverted-F antenna. Firstly, a prototype 31 of the inverted-F is provided. There are a gap 26 and a pillar 25 at the relative positions. The inverted-F antenna may be formed for the prototype 31 by a machine process.

Figure 4:
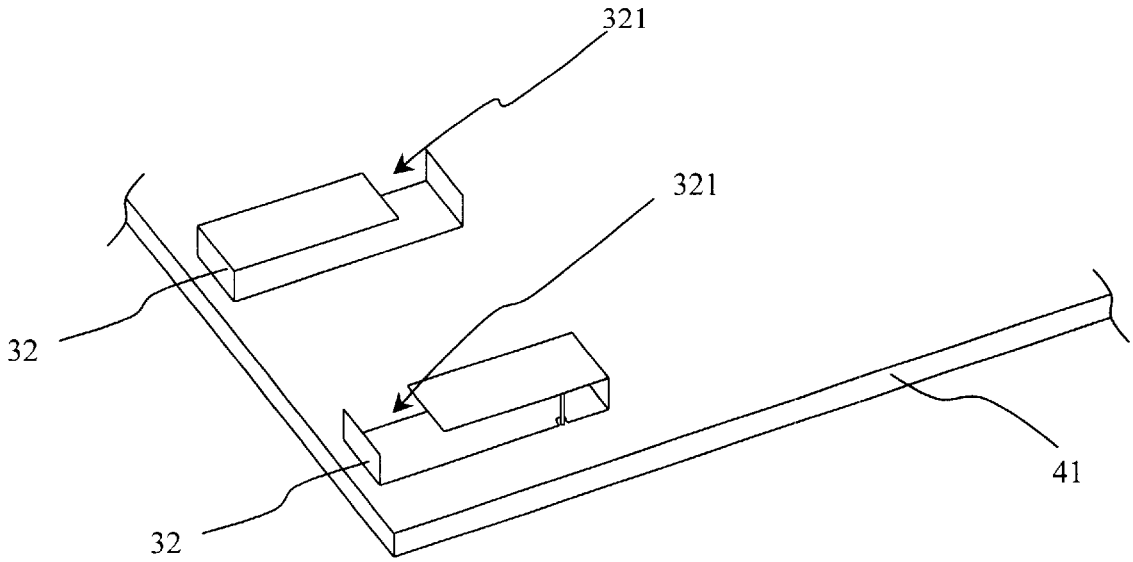
FIG. 4 is the structure that two inverted-F antennas are soldered on a printed circuit board (PCB).

Please refer to FIG. 4 showing the application of the inverted-F antenna. A wireless communication device always needs an antenna. There are two inverted-F antennas mounted on the printed circuit board 41. The direction of the antennas may be different. FIG. 4 shows the head 321 of an inverted-F antenna puts forward and another head 321 puts backward.

The feature of the present invention is on the pillar 25 design. The pillar 25 is designed on the margin so that the profits on manufacture may be issued.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An inverted-F antenna comprising:

a first plate;

a second plate connecting to said first plane and having a gap;

a third plane connecting to said second plate on an opposite side of said first plane;

a fourth plane connecting to said third plane and having a distance from said first plane on opposite side of said second plane; and a pillar connecting to a margin of said fourth plane and projecting to said gap of said second plane for forming said inverted-F antenna.

2. An inverted-F antenna according to claim 1 wherein said inverted-F antenna is made of a metal.

3. An inverted-F antenna according to claim 2 wherein said metal is a phosphor bronze.

4. An inverted-F antenna according to claim 1 wherein said gap is of "ㄇ" shape.

5. An inverted-F antenna according to claim 1 wherein said first plane is parallel to said third plane;

said second plane is parallel to said fourth plane;

said first plane is vertical to said second plane; and said third plane is vertical to said fourth plane.

6. An inverted-F antenna according to claim 1 wherein said pillar is vertical to said fourth plane and said second plane.

7. An inverted-F antenna according to claim 1 wherein said inverted-F antenna is connected to a printed circuit board.

8. An inverted-F antenna according to claim 7 wherein said printed circuit board has two said inverted-F antennas.

9. An inverted-F antenna according to claim 1 wherein said inverted-F antenna is formed in a body.

10. A method of forming an inverted-F antenna comprising the steps of:

providing a prototype of said inverted-F antenna; and forming said inverted-F antenna from said prototype in a method for forming in a body, wherein said inverted-F antenna comprises:

a first plate;

a second plate connecting to said first plane and having a gap;

third plane connecting to said second plate on an opposite side of said first plane;

fourth plane connecting to said third plane and having a distance from said first plane on an opposite side of said second plane; and a pillar connecting to a margin of said fourth plane and projecting to said gap of said second plane for forming said inverted-F antenna.

* * * * *